US011969099B1

(12) United States Patent
Shi

(10) Patent No.: US 11,969,099 B1
(45) Date of Patent: Apr. 30, 2024

(54) INFLATABLE BED

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/508,464

(22) Filed: Nov. 14, 2023

(30) Foreign Application Priority Data

Oct. 24, 2023 (CN) ..... 202322868745.7

(51) Int. Cl.
*A47C 27/08* (2006.01)
*A47C 27/14* (2006.01)
*A47C 27/18* (2006.01)

(52) U.S. Cl.
CPC ..... *A47C 27/087* (2013.01); *A47C 27/18* (2013.01); *A47C 27/081* (2013.01); *A47C 27/14* (2013.01)

(58) Field of Classification Search
CPC ..... A47C 27/087; A47C 27/08; A47C 27/081; A47C 27/082; A47C 27/088; A47C 27/14; A47C 27/18
USPC ..... 5/706, 709, 711, 712, 655.3, 644
See application file for complete search history.

(56) References Cited

U.S. PATENT DOCUMENTS 3,736,604 A * 6/1973 Carson, Jr. ..... A47C 27/087 5/678
4,803,744 A * 2/1989 Peck ..... A61B 5/1115 5/940
4,947,500 A * 8/1990 Seiler ..... A47C 27/18 5/713
4,955,095 A * 9/1990 Gerrick ..... A47C 31/105 5/691
5,070,560 A * 12/1991 Wilkinson ..... A47C 23/065 5/241
5,412,821 A * 5/1995 Wilkinson ..... A47C 23/065 5/709
5,524,307 A * 6/1996 Griffin ..... A47C 23/065 5/241
5,815,865 A * 10/1998 Washburn ..... A61G 7/05776 5/713
6,115,861 A * 9/2000 Reeder ..... A61G 7/05776 5/722
6,202,239 B1 * 3/2001 Ward ..... A47C 27/082 5/724
6,378,152 B1 * 4/2002 Washburn ..... A61G 7/05776 318/16
6,460,209 B1 * 10/2002 Reeder ..... A61G 7/05776 5/722

(Continued)

*Primary Examiner* — Robert G Santos
(74) *Attorney, Agent, or Firm* — Cooper Legal Group, LLC

(57) ABSTRACT

An inflatable bed includes a bed body and a mattress body, the bed body includes an outer support part and an inner support portion, the outer support part includes a top sheet, a first surrounding frame and a bottom sheet, the top sheet and the bottom sheet cover the first surrounding frame, the top sheet, the bottom sheet and the first surrounding frame are surrounding to form an inflatable cavity of the bed body, the inner support portion is arranged in the inside of the outer support part and is configured to support the outer support part; and a mattress body, the mattress body is arranged on a top of the bed body, the mattress body includes a comfort layer, a fixing layer, a sponge layer, a second fixing layer and a second surrounding frame.

10 Claims, 8 Drawing Sheets

(56) References Cited

U.S. PATENT DOCUMENTS

| | | | | |
|---|---|---|---|---|
| 6,687,935 | B2 * | 2/2004 | Reeder | A61G 7/05776 5/691 |
| 6,804,848 | B1 * | 10/2004 | Rose | A47C 27/18 5/710 |
| 6,952,852 | B2 * | 10/2005 | Reeder | A61G 7/05776 5/691 |
| 7,389,554 | B1 * | 6/2008 | Rose | A47C 27/18 5/710 |
| 7,849,541 | B2 * | 12/2010 | Gauger | A47C 27/081 5/678 |
| 2002/0178503 | A1 * | 12/2002 | Reeder | A61G 7/05776 5/722 |
| 2004/0133987 | A1 * | 7/2004 | Reeder | A61G 7/05776 5/713 |
| 2009/0193580 | A1 * | 8/2009 | Gauger | A47C 19/021 5/678 |

* cited by examiner

A

INFLATABLE BED

CROSS-REFERENCE TO RELATED APPLICATION

The present application claims the priority and benefit of Chinese patent application No. 202322868745.7, filed on Oct. 24, 2023. The entirety of Chinese patent application No. 202322868745.7 is hereby incorporated by reference herein and made a part of this specification.

TECHNICAL FIELD

The present application generally relates to a technical field of an inflatable production, and in particular, relates to an inflatable bed.

BACKGROUND

The inflatable bed is a movable production with a bed body structure after being inflated, which has a small size and a light weight. In the uninflated state, the size of the inflatable bed is equivalent to the size of a common bed sheet, which is foldable and easy to be carried. The inflatable bed can be inflated indoor or outdoor for placement and placed, which is suitable for home visitors, office nap, outdoor camping and other occasions, with a wide range of applications.

At present, the bed body of an inflatable bed is generally made of the fused waterproof fabric. However, the inflated bed body has a relative hard surface under the action of the expanded air, so that the waterproof fabric on the surface of the inflated bed body has a relative hard touch for the human skin, and the comfort is poor.

In order to improve the use comfort of the inflatable bed, it is proposed in the prior art that a mattress structure is provided on the surface of the inflatable bed. However, the mattress structure has a certain weight, and when the mattress structure is provided on the inflatable bed, the inflatable bed is prone to shake and the stability thereof is poor.

SUMMARY

In order to improve the stability of the inflatable bed, the present application provides an inflatable bed.

The inflatable bed according to the present application adopts the technical solution as follow.

An inflatable bed includes a bed body, the bed body includes an inner support portion and an outer support part, the outer support part includes a top sheet, a first surrounding frame and a bottom sheet, the top sheet and the bottom sheet cover the first surrounding frame, the top sheet, the bottom sheet and the first surrounding frame are surrounding to form an inflatable cavity of the bed body, the inner support portion is arranged in the inside of the outer support part and is configured to support the outer support part; and a mattress body, the mattress body is arranged on a top of the bed body, the mattress body includes a comfort layer, a fixing layer, a sponge layer, a second fixing layer and a second surrounding frame, the comfort layer, the first fixing layer, the sponge layer, and the second fixing layer are stacked from top to bottom, the second surrounding frame is sleeved on the sponge layer, the upper edge of the second surrounding frame is fixedly connected to the first fixing layer, and the lower edge of the second surrounding frame is fixedly connected to the second fixing layer.

In the above solution, the mattress body is arranged on the bed body to improve the comfort when the use uses the inflatable bed. The first fixing layer, the second fixing layer and the first surrounding frame wrap the sponge layer to support the sponge layer, and the comfort layer is connected to the human body to further improve the comfort when the use uses the inflatable bed. The top sheet, the bottom sheet and the first surrounding frame are formed the outer support part to support the mattress body, the inner support portion is arranged in the inside of the outer support part to support the outer support part, which is conducive to improving the structure strength of the outer support part, and the inner support portion and the outer support part are commonly support the mattress body, so that the mattress body is hard to shake, thereby being conducive to improving the stability of the bed body supporting the mattress body, and further being conducive to improving the stability of the inflatable bed.

Preferably, the inner support portion includes an inner support part and a drawing strap, a top of the inner support part is fixedly connected to the top sheet, a bottom of the inner support part is fixedly connected to the bottom sheet, the inner support part divides the inflatable cavity into a middle cavity and a periphery cavity surrounding the middle cavity, the drawing strap is located in the middle cavity, a top of the drawing strap is fixedly connected to the top sheet, and a bottom of the drawing strap is fixedly connected to the bottom sheet.

In the above solution, the top of the inner support part is fixedly connected to the top sheet, the bottom of the inner support part is fixedly connected to the bottom sheet, the inner support part divides the inflatable cavity into the middle cavity and the periphery cavity, which is conducive to improving the structure strength of the bed body. The top of the drawing strap is fixedly connected to the top sheet, the bottom of the drawing strap is fixedly connected to the bottom sheet, such that the drawing strap supports the bed body, which is conducive to improving the structure strength of the bed body, thereby being conducive to improving the structure stability of the bed body, and being conducive to further improving the stability of the bed body supporting the mattress body.

Preferably, the inner support part is formed by a plurality of enclosing pieces connected each other end to end, each of the enclosing piece is formed with an assembling hole, each of the enclosing piece is provided with a breathable mesh configured to cover the enclosing piece, and a shape and a size of the breathable mesh are matched with a shape and a size of the assembling hole.

In the above solution, the inner support part is formed by a plurality of the enclosing pieces connected to each other end to end, so as to synchronously assemble the breathable meshes on a plurality of the enclosing pieces, and then the enclosing pieces loaded with the breathable meshes are assembled together to form the inner support part, which is conducive to improving the assembling effective and the assembling convenience.

Preferably, the quantity of the drawing straps is arranged as multiple, a plurality of the drawing strap is arranged in an array in the middle cavity, and a connecting portion of the top sheet and the drawing strap is concave.

In the above solution, a plurality of the drawing straps are arranged in an array in the middle cavity, which is conducive to further improving the support stability for the bed body. The connecting portion of the top sheet and the drawing strap is concave, which can improve the friction between the mattress body and the bed body, thereby being conducive to improving the stability when the mattress body is arranged on the bed.

Preferably, the upper edge of the second surrounding frame extends upward to form a projection, and the projection is higher than the comfort layer.

By adopting the above solution, when the use uses the inflatable bed and connects to the comfort layer, the projection higher than comfort layer provides a protection function, which is conducive to improving the safety.

Preferably, the second surrounding frame is provided with a discharge valve, and the discharge valve is in combination with a space of the sponge layer.

By adopting the above solution, the air of the space of the sponge can be discharged via the discharged valve, thereby being conducive to improving the comfort when the user uses the inflatable bed.

Preferably, the mattress body is fixedly arranged on the top of the bed body, and a periphery of the mattress body is aligned with a periphery of the bed body in a vertical direction.

In the above solution, the mattress body is fixed on the top of the bed body, which is conducive to improving the stability between the mattress body and the bed body. The periphery of the mattress body is aligned with the periphery of the bed body in the vertical direction, which is conducive to improving the evenness between the mattress body and the bed body.

Preferably, the top of the bed body is provided with a plurality of female snap fasteners, a bottom of the mattress body is provided with a plurality of male snap fasteners relating to a plurality of the female snap fasteners, and when a plurality of the male snap fasteners are correspondingly snapped with a plurality of the female snap fasteners, a periphery of the mattress body is aligned with a periphery of the bed body in a vertical direction.

In the above solution, the mattress body is connected to the bed body via the snapping of the male snap fastener and the female snap fastener, when the mattress body is connected to the bed body, the periphery of the mattress body is aligned with the periphery of the bed body in the vertical direction, which is conducive to improving the evenness between the mattress body and the bed body, when there is no requirement for using the mattress body, the use detaches the connection of the mattress body and the bed body by detaching the snapping of the male snap fastener and the female snap fastener.

Preferably, the top of the bed body is provided with a hook, a bottom of the mattress body is correspondingly provided with a loop, and when the loop is attached on the hook, a periphery of the mattress body is aligned with a periphery of the bed body in a vertical direction.

By adopting the above solution, the mattress body is connected to the bed body via the attachment of the hook and the loop. When the mattress body is connected to the bed body, the periphery of the mattress body is aligned with the periphery of the bed body in the vertical direction, which is conducive to improve the evenness between the mattress body and the body. When there is no requirement for using the mattress body, the use detaches the connection of the mattress body and the bed body by detaching the attachment of the hook and the loop.

Preferably, the top of the bed body is provided with a first side zipper chain, a bottom of the mattress body is provided with a second side zipper chain, the second side zipper chain is provided with a slider configured to be engaged with the first side zipper chain, and when the second side zipper chain is engaged with the first side zipper chain via the slider, a periphery of the mattress body is aligned with a periphery of the bed body in a vertical direction.

In the above solution, the mattress body is connected to the bed body by the engagement of the second side zipper chain and the first side zipper chain. When the mattress body is connected to the bed body, the periphery of the mattress body is aligned with the periphery of the bed body in the vertical direction, which is conducive to improving the evenness between the mattress body and the body. When there is no requirement for using the mattress body, the use detaches the connection of the mattress body and the bed body by detaching the engagement of the first side zipper chain and the second side zipper chain.

In summary, at least one of the following beneficial technical effects is realized:

1. By providing the inner support portion and the outer support part, the inner support portion is arranged in the outer support part to support the support part, which is conducive to improving the structure strength of the outer support part, and the inner support portion and the outer support part are commonly support for the mattress body, so that the mattress body is hard to shake, thereby being conducive to improving stability of the bed body supporting the mattress body, and further being conducive to improving the stability of the inflatable bed.

2. By providing the inner support part and the drawing strap, the inner support part divides the inflatable cavity into a middle cavity and a periphery cavity, which is conducive to improving the structure strength of the bed body. The drawing strap supports the bed body, which is conducive to further improving the structure strength of the bed body, thereby being conducive to improving the structure stability of the bed body, and being conducive to further improving the stability of the bed body supporting the mattress body.

3. An upper edge of the second surrounding frame extends upward to form a projection higher than a comfort layer, and when the use uses the inflatable bed and connects to the comfort layer, the projection higher than the comfort layer provides a protection function, which is conducive to improving the safety.

DETAILED DESCRIPTION

The present application is further described in detail below with reference to FIGS. 1-8.

Embodiment 1

Figure 1:
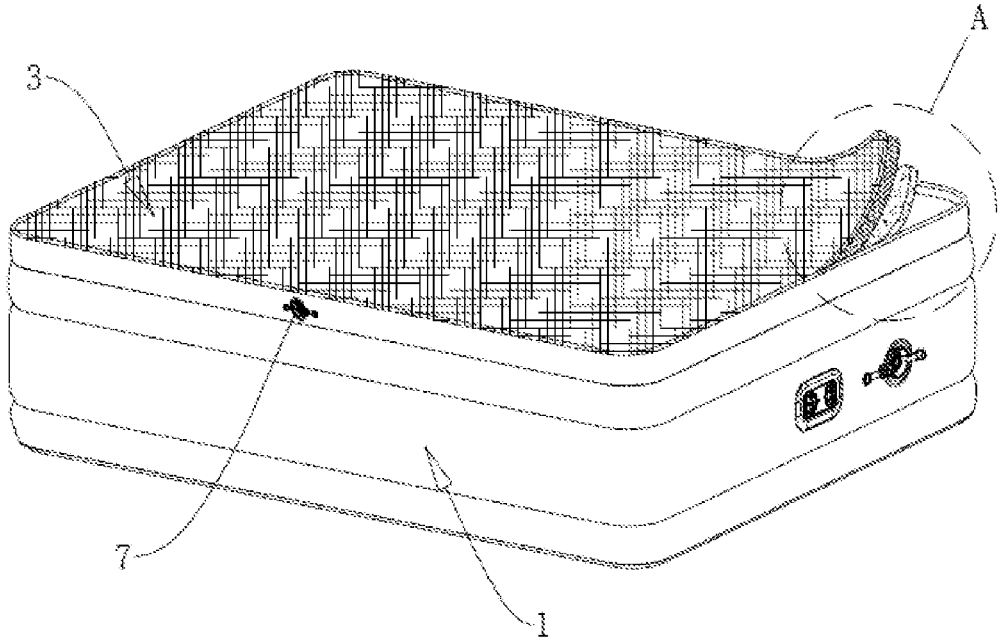
FIG. 1 is a schematic diagram of an overall structure of an inflatable bed according to Embodiment 1 of the present application.

An inflatable bed according to Embodiment 1 of the present application is disclosed, referring to FIG. 1, the inflatable bed includes a bed body 1 and a mattress body 3, and the bed body 1 and the mattress body 3 are rectangle-shaped. The mattress body 3 is fixedly arranged on a top of the bed body 1, in the present application, the mattress body 3 is fixed on the top of the bed body 1 by welding, and the periphery of the mattress body 3 is aligned with the periphery of the bed body 1 in a vertical direction, thereby improving the evenness that the mattress body 3 is connected to the bed body 1.

Figure 2:
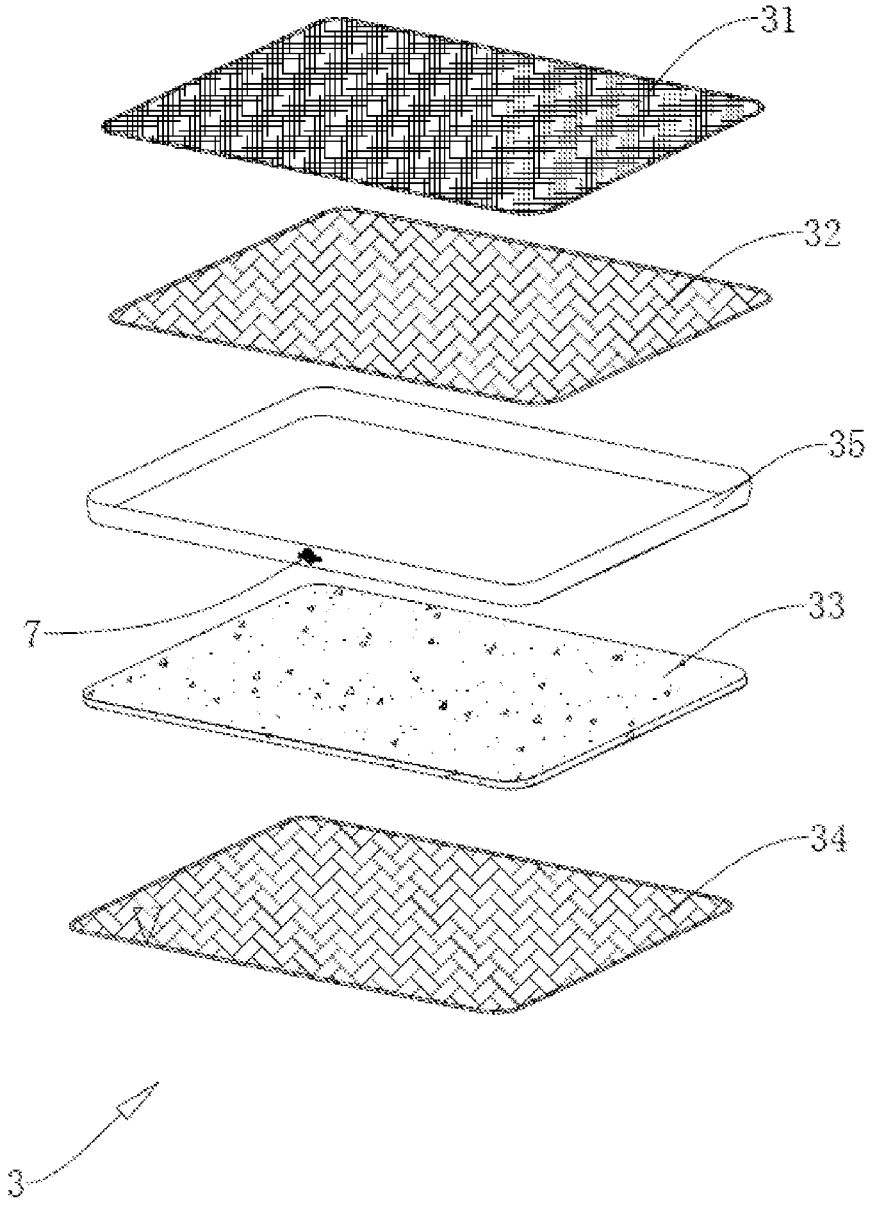
FIG. 2 is an exploded view of a mattress body according to Embodiment 1 of the present application.

Referring to FIGS. 1-2, the mattress body 3 includes a comfort layer 31, a first fixing layer 32, a sponge layer 33, a second fixing layer 34 and a second surrounding frame 35, wherein the comfort layer 31, the first fixing layer 32, the sponge layer 33 and the second fixing layer 34 are stacked from top to bottom, the second surrounding frame 35 formed as rectangle-shaped is sleeved on the sponge layer 33, at same time, the upper edge of the second surrounding frame 35 is fixedly connected to the first fixing layer 32, and the lower edge of the second surrounding frame 35 is fixedly connected to the second fixing layer 34, such that the second surrounding frame 35, the first fixing layer 32 and the second fixing layer 34 wrap the sponge layer 33 to support the sponge layer 33. In the present embodiment, the first fixing layer 32, the second fixing layer 34 and the second surrounding frame 35 are all made of PVC material, such that the mattress body 3 have a certain ductility, can adaptively adjust shape when being used, and is not easily to be damaged. The comfort layer 31 adopts the comfortable material such as cotton, flax, and silk. The comfort layer 31 is fixedly bonded on the surface of the first fixing layer 32 departing from the sponge layer 33 to connect to the use. It is worthy mentioned that, the comfort layer 31 is provided with polymer particles of polyester polyol, amino acids or polyamides that can produce the cool feeling, thereby further improving the comfort.

Figure 3:
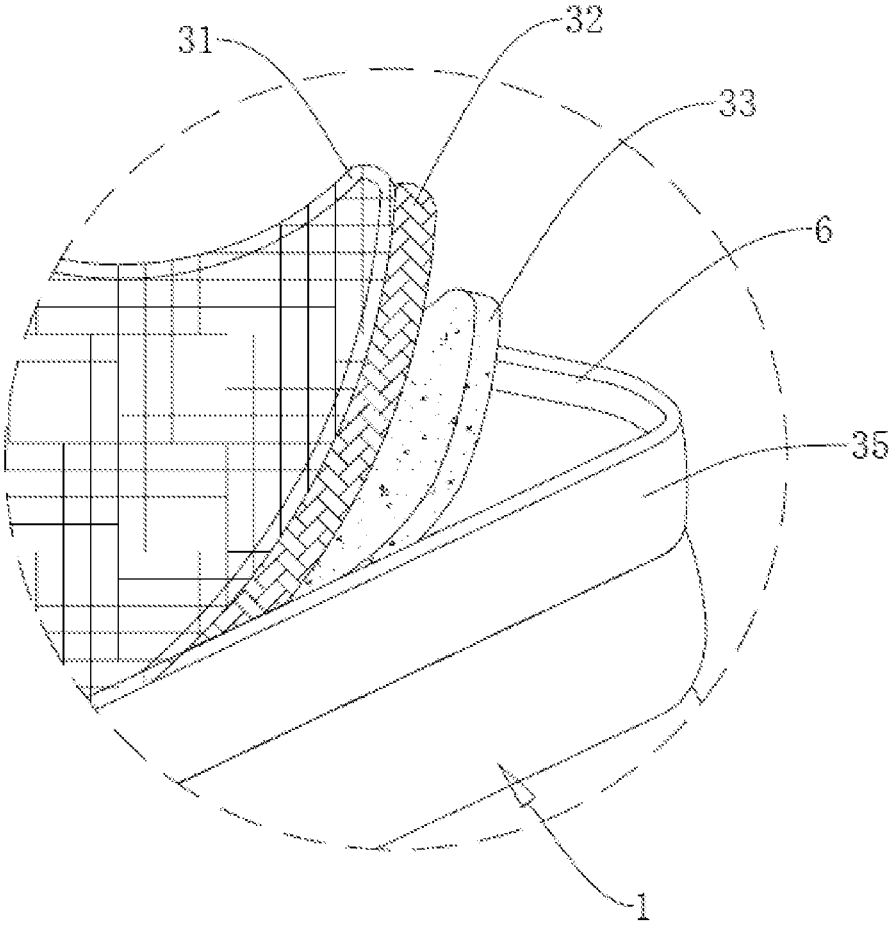
FIG. 3 is an enlarged view of a portion A in FIG. 1.

Referring to FIGS. 2-3, the upper edge of the second surrounding frame 35 is extended upwards, so as to form an annular projection 6 around the comfort layer 31, the annular projection 6 is higher than the comfort layer 31. When the user uses the inflatable bed and touches the comfort layer 31, the annular projection 6 higher than comfort layer 31 is configured with a certain protection function, thereby improving the safety, and which is conducive to preventing the production placed on the comfort layer 31 from slipping. In addition, the second surrounding frame 35 is provided with a discharge valve 7, the discharge valve 7 is in combination with the space of the sponge layer 33, when the user sits on the mattress body 3, the use compresses the sponge layer 33, the air of the space of the sponge layer 33 can be discharged via the discharge valve, thereby improving the comfort when the use uses the inflatable bed.

Figure 4:
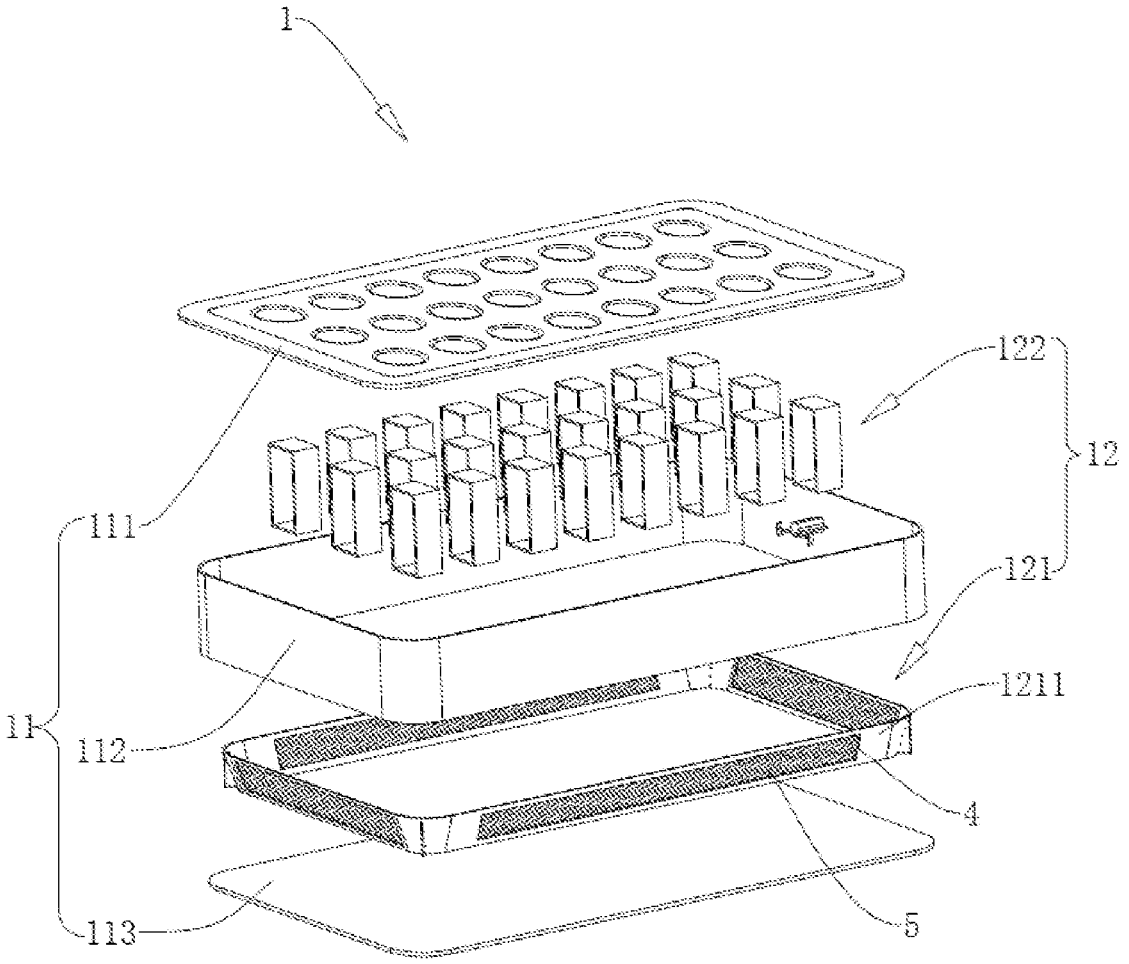
FIG. 4 is an exploded view of a bed body according to Embodiment 1 of the present application.
Figure 5:
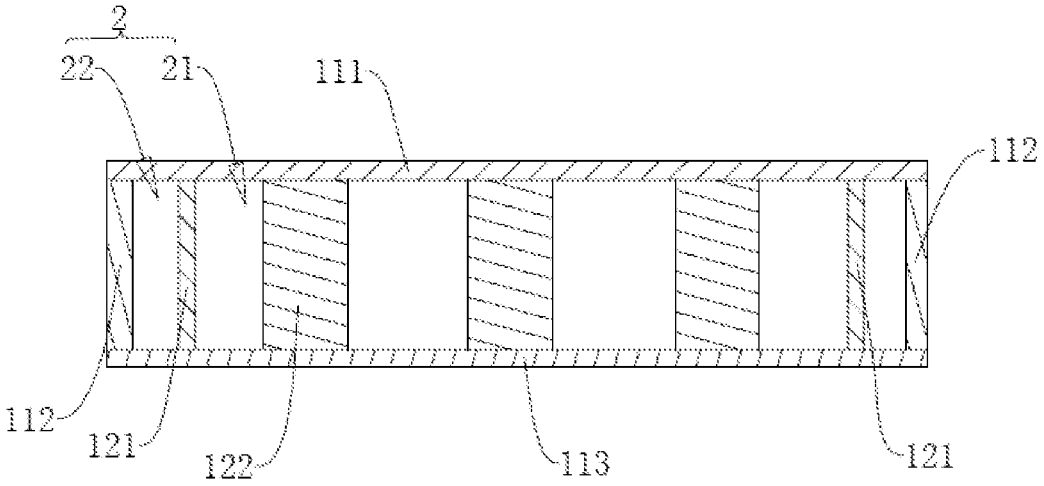
FIG. 5 is a schematic vertical sectional view of the bed body according to Embodiment 1 of the present application.

Referring to FIGS. 4-5, the bed body 1 includes an outer support part 11 and an inner support portion 12, the inner support portion 12 is arranged in the inside of the outer support part 11 to support the outer support part 11, and then the outer support part 11 and the inner support portion 12 both support the mattress body 3, thereby improving the stability of the inflatable bed.

Specifically, the outer support part 11 includes a top sheet 111, a first surrounding frame 112 and a bottom sheet 113, the top sheet 111 and the bottom sheet 113 are arranged as slice-shaped, the first surrounding frame 112 are arranged with upper and lower openings, the top sheet 111 and the bottom sheet 113 cover the first surrounding frame 112, and are welded and fixedly sealed with the first surrounding frame 112, such that the top sheet 111, the bottom sheet 113 and the first surrounding frame 112 are surrounding to form an inflatable cavity 2 of the bed body 1. When the use inflates the gas into the inflatable cavity 2, the top sheet 111, and the bottom sheet 113 and the first surrounding frame 112 are formed a rectangle-shaped structure.

Referring to FIGS. 4-5, the inner support portion 12 includes an inner support part 121, the inner support part 121 is located between the top sheet 111 and the bottom sheet 113, the top of the inner support part 121 is fixedly connected to the top sheet 111, and the bottom of the inner support part 121 is fixedly connected to the bottom sheet 113, such that the inner support part 121 divides the inflatable cavity 2 into a middle cavity 21 and a periphery cavity 22. The inner support part 121 supports the outer support part 11 to improve the structure strength of the outer support part 11.

Referring to FIGS. 4-5, the inner support part 121 is formed by a plurality of enclosing pieces 1211, in the present application, the enclosing pieces 1211 are further made of PVC material, the quantity of the enclosing pieces 1211 is arranged as four, four enclosing pieces 1211 are formed a frame by a head to tail connection, each of the enclosing pieces 1211 is formed an assembling hole 4, at same time, each of the enclosing pieces 1211 are provided with a breathable mesh 5, the shape and the size of the breathable mesh 5 are matched with the shape and the size of the assembling hole 4, and the middle cavity 21 is in combination with the periphery cavity 22 by the breathable mesh 5.

Referring to FIGS. 4-5, the inner support portion 12 further includes a drawing strap 122, the drawing strap 122 is located in the middle cavity 21, the top of the drawing strap 122 is fixedly connected to the top sheet 111, the bottom of the drawing strap 122 is fixedly connected to the bottom sheet 113, such that the drawing strap 122 supports the outer support part 11. In the present application, the quantity of the drawing strap 122 is arranged as multiple, and a plurality of the drawing straps 122 are arranged in a rectangle array in the middle cavity 21, thereby further improving the stability of the drawing strap 122 supporting the outer support part 11. It is worthy mentioned that, the top sheet 111 is fixedly connected to the drawing strap 122 by high-frequency heat sealing, such that the connecting portion of the top sheet 111 and the drawing strap 122 is concave. When the mattress body 3 is connected to the bed body 1, the concave of the top sheet 111 increases the friction between the bed body 1 and the mattress body 3, thereby being conducive to improving the stability when the bed body 1 is connected to the mattress body 3.

An implement principle of above embodiment is as follow: the mattress body 3 is connected to the bed body 1 to improve the comfort when the use uses the inflatable bed. The top sheet 111, the bottom sheet 113 and the first surrounding frame 112 are formed the outer support part 11 to form a first support for the mattress body 3. The inner support portion formed by four enclosing pieces 1211 divides the inflatable cavity 2 into the middle cavity 21 and the periphery cavity 22, thereby improving the structure strength of the outer support part 11, and at same time supports the outer support part 11 and the mattress body 3 to form a second support. A plurality of the drawing straps 122 arranged in a rectangle array in the middle cavity further improves the structure strength of the outer supporting part 11, and supports the outer support part 11 and the mattress body 3 to form a third support. Therefore, the mattress body 3 is hard to shake, thereby being conducive to improving the stability of the bed body 1 supporting the mattress body 3, and being conducive to improving the stability of the inflatable bed.

Embodiment 2

Figure 6:
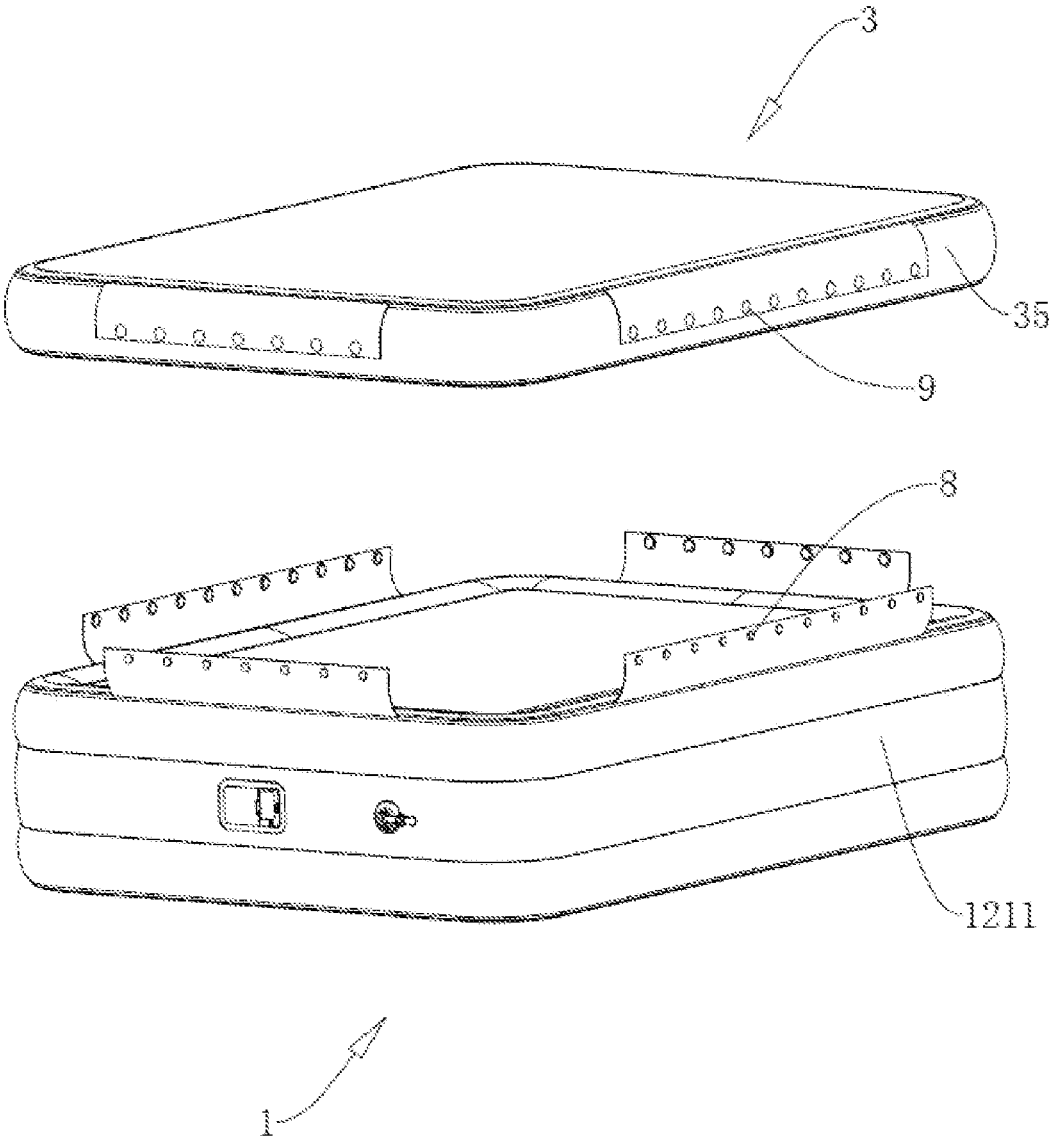
FIG. 6 is a schematic structure view of an inflatable bed according to Embodiment 2 of the present application.

Referring to FIG. 6, this embodiment differs from Embodiment 1 in that, the top of bed body 1 is provided with a plurality of female snap fasteners 8, the bottom of the mattress body 3 relating to a plurality of the female snap fastener 8 is provided with a plurality of male snap fasteners 9, when a plurality of the male snap fastener 9 is correspondingly snapped with a plurality of the female snap fastener 8, the periphery of the mattress body 3 is aligned with to the periphery of the bed body 1 in the vertical direction, and the combination of the female snap fastener 8 and the male snap fastener 9 realizes the detachable connection of the bed body 1 and the mattress body 3.

Specifically, the male snap fastener 9 is arranged on the outer periphery of the second surrounding frame 35, the female snap fastener 8 is arranged on the upper outer periphery of the enclosing pieces 1211, when the mattress body 3 is arranged on the bed body 1 and the periphery of the mattress body 3 is aligned with the periphery of the bed body 1 in the vertical direction, the male snap fastener 9 is aligned and snapped with the female snap fastener 8, thereby realizing the connection of the bed body 1 and the mattress body 3, when there is no requirement for using the mattress body 3 or a requirement for replacing the mattress body 3, the use detaches the snapping of the male snap fastener 9 and the female snap fastener 8.

An implement principle of above embodiment is similar to the implement principle of Embodiment 1, there is no repeated description herein.

Embodiment 3

Figure 7:
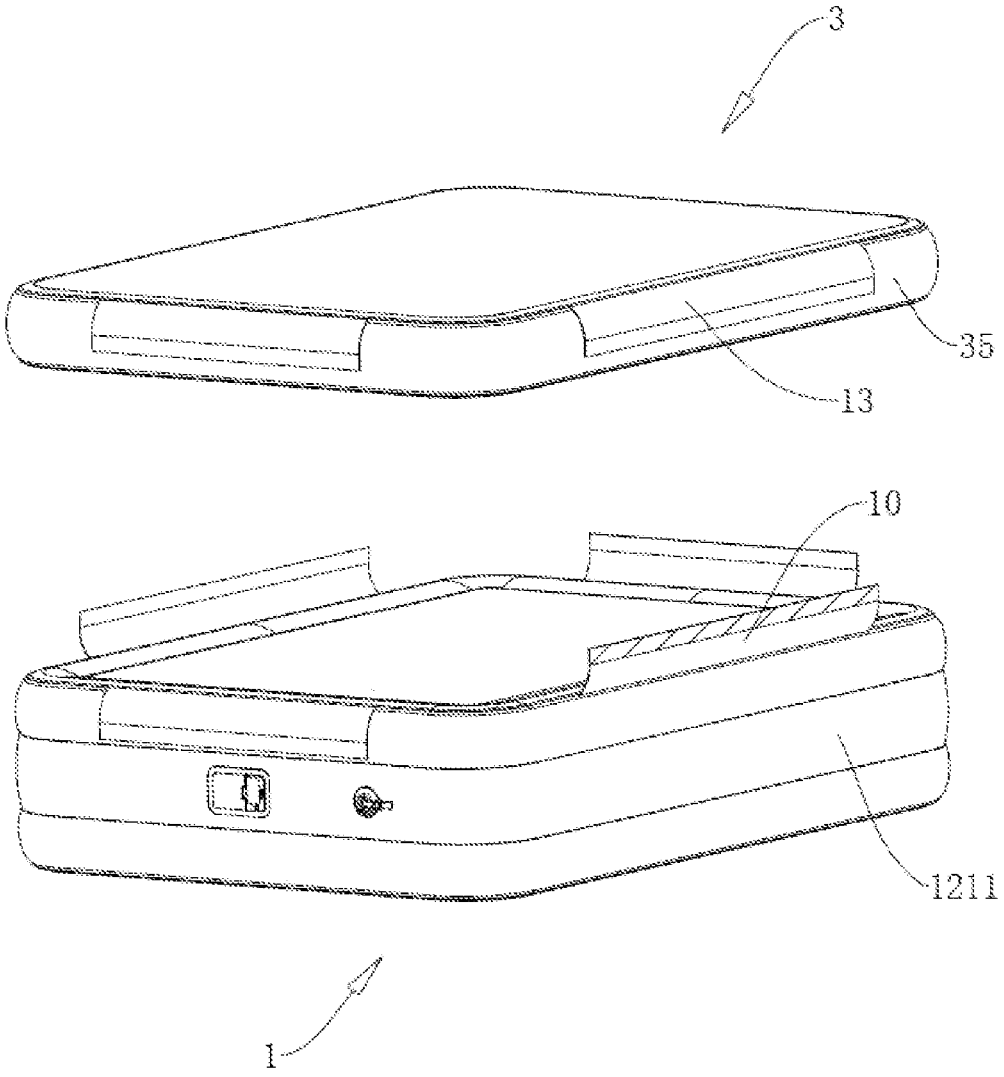
FIG. 7 is a schematic structure view of an inflatable bed according to Embodiment 3 of the present application.

Referring to FIG. 7, this embodiment differs from Embodiment) in that, the top of the bed body 1 is provided with a mother magic tape 10, the bottom of the mattress body 3 is correspondingly provided with a child magic tape 13, when the child magic tape 13 is attached with the mother magic tape 10, the periphery of the mattress body 3 is aligned with the periphery of the bed body 1 in the vertical direction, and the combination of the mother magic tape 10 and the child magic tape 13 realizes the detachable connection of the bed body 1 and the mattress body 3.

Specifically, the child magic tape 13 is arranged on the outer periphery of the second surrounding frame 35, the mother magic tape 10 is arranged on the upper outer periphery of the enclosing pieces 1211, when the mattress body 3 is arranged on the bed body 1 and the periphery of the mattress body 3 is aligned with the periphery of the bed body 1 in the vertical direction, the mother magic tape 10 is rotated to a portion where the hook is attached with the child magic tape 13, thereby realizing the connection of the bed body 1 and the mattress body 3, when there is no requirement for using the mattress body 3 or a requirement for replacing the mattress body 3, the use detaches the attachment of the mother magic tape 10 and the child magic tape 13.

An implement principle of above embodiment is similar to the implement principle of Embodiment 1, there is no repeated description herein.

Embodiment 4

Figure 8:
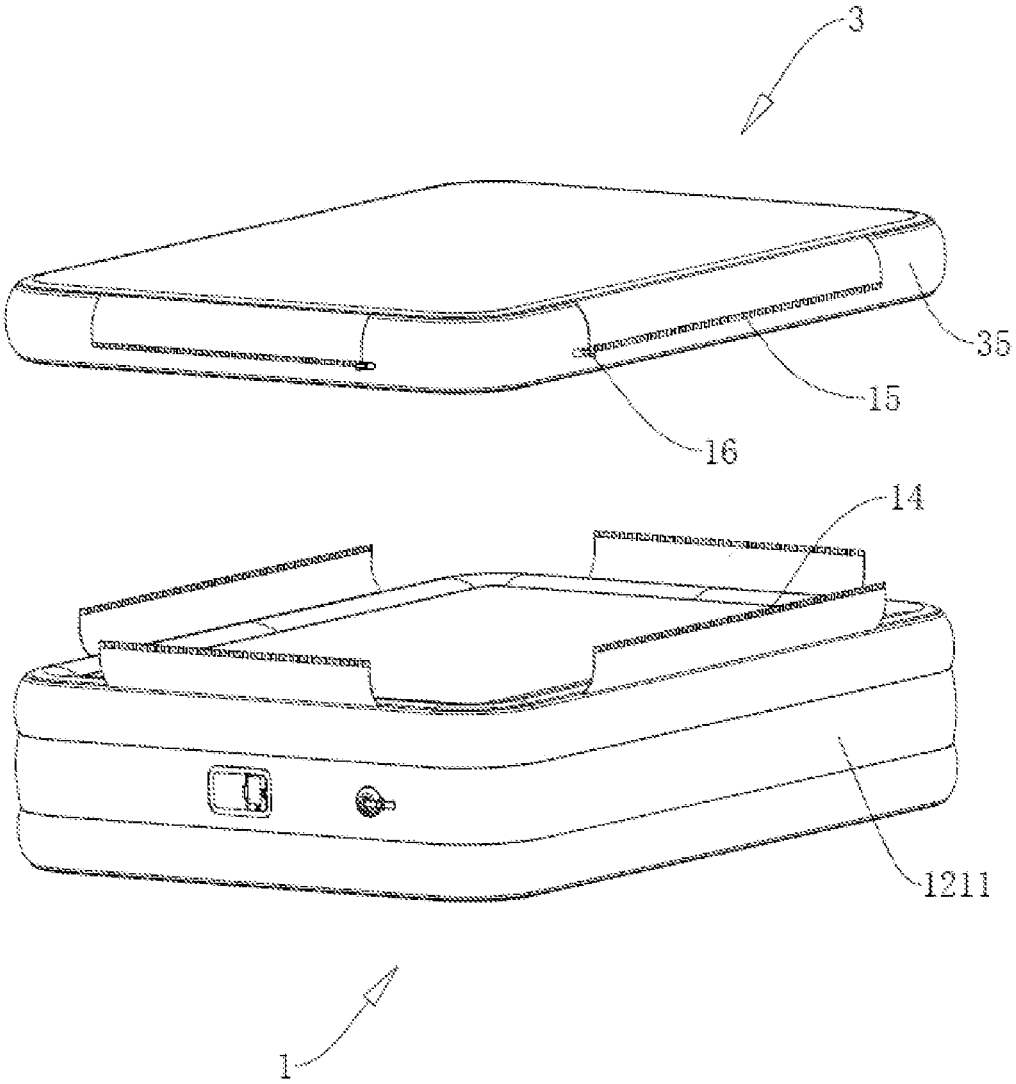
FIG. 8 is a schematic structure view of an inflatable bed according to Embodiment 4 of the present application.

Referring to FIG. 8, this embodiment differs from Embodiment 1 in that, the top of the bed body 1 is provided with a first side zipper chain 14, the bottom of mattress body 3 is provided with a second side zipper chain 15, in which the second side zipper chain 15 is provided with a slider 16 that configured to be engaged with the first side zipper chain 14, when the second side zipper chain 15 is engaged with the first side zipper chain 14 via the slider 16, the periphery of the mattress body 3 is aligned with the periphery of the bed body 1 in the vertical direction, and the combination of the first side zipper chain 14 and the second side zipper chain 15 realizes the detachable connection of the bed body 1 and the mattress body 3.

Specifically, the first side zipper chain 14 is arranged on the upper outer periphery of the enclosing pieces 1211, the second side zipper chain 15 is arranged on the outer periphery of the second surrounding frame 35. When the mattress body 3 is arranged on the bed body 1 and the periphery of the mattress body 3 is aligned with the periphery of the bed body 1 in the vertical direction, the first side zipper chain 14 is engaged with the second side zipper chain 15 via the slider 16, thereby realizing the connection of the bed body 1 and the mattress body 3, when there is no requirement for using the mattress body 3 or a requirement for replacing the mattress body 3, the use detaches the engagement of the first side zipper chain 14 and the second side zipper chain 15 by drawing the slider 16.

An implement principle of above embodiment is similar to the implement principle of Embodiment 1, there is no repeated description herein.

The above are the preferred embodiments of the present application, which are not intended to limit the protection scope of the present application. Therefore, all equivalent changes made according to the structure, shape and principle of the present application should be covered in the protection scope of the present application.

LISTING OF REFERENCE SIGNS

1 bed body
11 outer support part
111 top sheet
112 first surrounding frame
113 bottom sheet
12 inner support portion
121 inner support part
1211 enclosing piece
122 drawing strap
2 inflatable cavity
21 middle cavity
22 periphery cavity
3 mattress body
31 comfort layer
32 first fixing layer
33 sponge layer
34 second fixing layer
35 second surrounding frame
4 assembling hole
5 breathable mesh
6 projection
7 discharge valve
8 female snap fastener
9 male snap fastener
10 mother magic tape
13 child magic tape
14 first side zipper chain
15 second side zipper chain
16 slider

What is claimed is:

1. An inflatable bed, comprising:

a bed body, wherein the bed body comprises an inner support portion and an outer support part, the outer support part comprises a top sheet, a first surrounding frame and a bottom sheet, the top sheet and the bottom sheet cover the first surrounding frame respectively from above and from below surrounding to form an inflatable cavity of the bed body, and the inner support portion is arranged inside the outer support part for supporting the outer support part; and a mattress body arranged on a top of the bed body, wherein the mattress body comprises a comfort layer, a first fixing layer, a sponge layer, a second fixing layer and a second surrounding frame, the comfort layer, the first fixing layer, the sponge layer, and the second fixing layer are sequentially stacked from top to bottom, the second surrounding frame is sleeved on the sponge layer, an upper edge of the second surrounding frame is fixedly connected to the first fixing layer, and a lower edge of the second surrounding frame is fixedly connected to the second fixing layer.

2. The inflatable bed according to claim 1, wherein the inner support portion comprises an inner support part and one or more drawing straps, a top of the inner support part is fixedly connected to the top sheet, a bottom of the inner support part is fixedly connected to the bottom sheet, the inner support part is configured to divide the inflatable cavity into a middle cavity and a periphery cavity surrounding the middle cavity, the one or more drawing straps are located in the middle cavity, a top of the one or more drawing straps is fixedly connected to the top sheet, and a bottom of the one or more drawing straps is fixedly connected to the bottom sheet.

3. The inflatable bed according to claim 2, wherein the inner support part is formed by a plurality of enclosing pieces connected to each other end to end, an assembling hole is provided on each of the plurality of enclosing pieces, a breathable mesh is provided on each of the plurality of enclosing pieces for covering each of the assembling holes, and a shape and a size of each of the breathable meshes are matched with a shape and a size of each of the assembling holes.

4. The inflatable bed according to claim 2, wherein, in a case where the one or more drawing straps comprise a plurality of drawing straps, the plurality of drawing straps are arranged in an array in the middle cavity, and each of connecting portions of the top sheet at which the top sheet is connected with each of the plurality of drawing straps is concave.

5. The inflatable bed according to claim 1, wherein the upper edge of the second surrounding frame is configured to extend upward to form a projection higher than the comfort layer.

6. The inflatable bed according to claim 1, wherein the second surrounding frame is provided with a discharge valve, and the discharge valve is in communication with a space in which the sponge layer is located.

7. The inflatable bed according to claim 1, wherein the mattress body is fixedly arranged on the top of the bed body, and a periphery of the mattress body is aligned with a periphery of the bed body in a vertical direction.

8. The inflatable bed according to claim 1, wherein a plurality of female snap fasteners are provided on the top of the bed body, a plurality of male snap fasteners, corresponding to the plurality of female snap fasteners, are provided on a bottom of the mattress body, and when the plurality of male snap fasteners are correspondingly snapped with the plurality of female snap fasteners, a periphery of the mattress body is aligned with a periphery of the bed body in a vertical direction.

9. The inflatable bed according to claim 1, wherein a mother magic tape is provided on the top of the bed body, a child magic tape is correspondingly provided on a bottom of the mattress body, and when the mother magic tape is attached to the child magic tape, a periphery of the mattress body is aligned with a periphery of the bed body in a vertical direction.

10. The inflatable bed according to claim 1, wherein a first side zipper chain is provided on the top of the bed body, a second side zipper chain is provided on a bottom of the mattress body, the second side zipper chain is provided with a slider configured to be engaged with the first side zipper chain, and when the second side zipper chain is engaged with the first side zipper chain by the slider, a periphery of the mattress body is aligned with a periphery of the bed body in a vertical direction.

* * * * *